US006311421B1

(12) United States Patent
Knight

(10) Patent No.: US 6,311,421 B1
(45) Date of Patent: Nov. 6, 2001

(54) CROSS-FIRE BREECH PLUG

(75) Inventor: William A. Knight, Centerville, IA (US)

(73) Assignee: EBSCO Industries, Inc., Birmingham, AL (US)

( * ) Notice: Subject to any disclaimer, the term of this patent is extended or adjusted under 35 U.S.C. 154(b) by 0 days.

(21) Appl. No.: 09/588,137

(22) Filed: Jun. 2, 2000

(51) Int. Cl.[7] ..... F41C 9/08
(52) U.S. Cl. ..... 42/51
(58) Field of Search ..... 42/14, 26, 51; 89/1.3, 17, 19

(56) References Cited

U.S. PATENT DOCUMENTS

| | | | | |
|---|---|---|---|---|
| 5,010,677 | * | 4/1991 | Carron | 42/51 |
| 5,561,934 | | 10/1996 | Knight . | |
| 5,644,861 | * | 7/1997 | Knight | 42/51 |
| 5,651,203 | | 7/1997 | Knight . | |
| 5,706,598 | * | 1/1998 | Johnston | 42/51 |
| 5,860,240 | * | 1/1999 | Ball et al. | 42/51 |
| 6,176,030 | * | 1/2001 | Ball | 42/51 |

* cited by examiner

*Primary Examiner*—Charles T. Jordan
*Assistant Examiner*—Elizabeth Shaw
(74) *Attorney, Agent, or Firm*—Zarley, McKee, Thomte, Voorhees & Sease

(57) ABSTRACT

A breech plug having an elongated body with external threads that is threadably mounted adjacent to the rearward end of the bore of a barrel of a conventional muzzle-loading rifle. The body having both forward and rearward ends with a circular depression in the forward end and surrounded by an annular rim. The circular depression having a tapered bottom surface that slopes inwardly and rearwardly and terminates in the center portion in communication with a center bore that extends longitudinally along a center axis of the body. Within the circular depression are a pair of intersecting grooves that extend across the depression. The grooves have outer ends that extend from the outer edge of the rim inwardly and rearwardly across the tapered bottom surface to the center portion in communication with the center bore of the body to permit an ignition flame emerging from the center bore to move forwardly and outwardly through the grooves to the inner diameter of the bore of the barrel to ignite a propellant.

5 Claims, 1 Drawing Sheet

CROSS-FIRE BREECH PLUG

BACKGROUND OF THE INVENTION

Conventional muzzle-loading rifles include a barrel which extends forwardly from a receiver, the rearward end of the barrel having a breech which receives propellant and projectile through the muzzle. A breech plug is threadably mounted in the receiver and seals the rearward end of the barrel, in the breech, to prevent blow back of gases upon ignition of the propellant within the breech.

In percussion muzzle-loaders a percussion element is positioned rearwardly of the breech plug such that when struck by a hammer, the percussion element is fired and an ignition flame travels through a central bore in the breech plug to ignite the propellant in the breech. Conventional breech plugs work fine with loose powder, but are less effective with powder in pellet form.

One problem with a conventional breech plug is that it limits the area of exposure on the base of the pelletized powder that is exposed to the burning gases from the ignition source. This results in slower ignition, velocity, and lock time.

It is therefore a general object of the present invention to provide an improved breech plug for a muzzle-loading rifle.

Another object of the present invention is to provide a breech plug that improves the ignition of a pelletized powder charge.

Another object of the present invention is to provide an improved breech plug which will increase the area of exposure of the propellant base to the ignition charge.

Another object of the present invention which provides a faster ignition, greater velocity, and increased lock time.

These and other objects will be apparent to those skilled in the art.

SUMMARY OF THE INVENTION

The breech plug of the present invention has an elongated body with external threads. The breech plug is threadably mounted adjacent to the rearward end of the bore of the barrel of a conventional muzzle-loading rifle. The body has a forward and rearward end with a circular depression in the forward end surrounded by an annular rim. The annular rim has a diameter slightly less than the diameter of the bore of the rifle.

The circular depression has a tapered bottom surface that slopes inwardly and rearwardly and terminates in a center portion in communication with a center bore that extends longitudinally along a center axis of the body.

Within the circular depression are a pair of intersecting grooves that extend across the depression. The grooves have outer ends that extend from the rim inwardly and rearwardly across the tapered bottom surface to the center portion in communication with the center bore of the body to permit an ignition flame emerging from the center bore to move forwardly and outwardly through the grooves to the inner diameter of the bore of the barrel to ignite a pelletized powder charge.

DETAILED DESCRIPTION OF THE INVENTION

Figure 1:
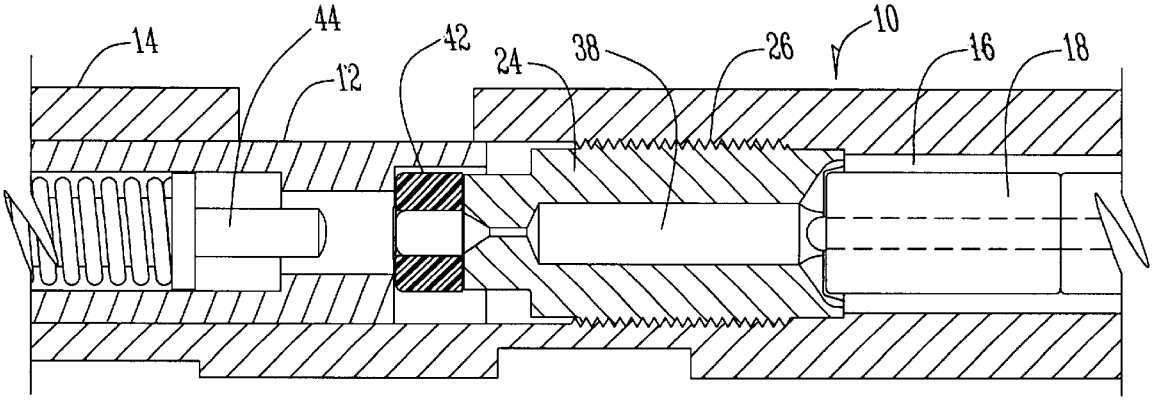
FIG. 1 is a top view of a breech plug threadably mounted in the barrel of a rifle.
Figure 2:
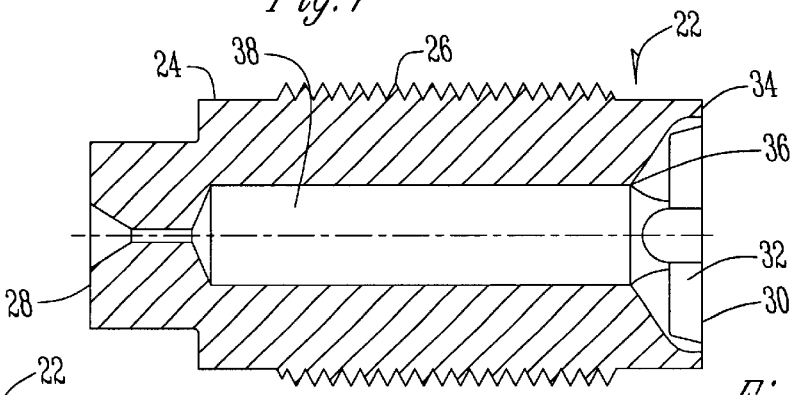
FIG. 2 is a top view of the breech plug of the present invention.
Figure 3:
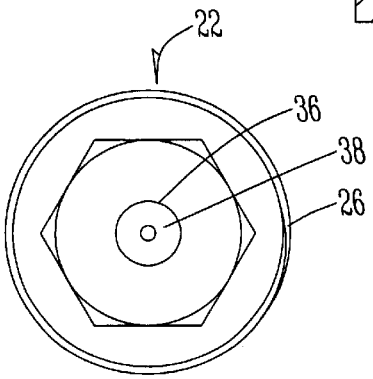
FIG. 3 is a n end view of the rearward end of the breech plug.
Figure 4:
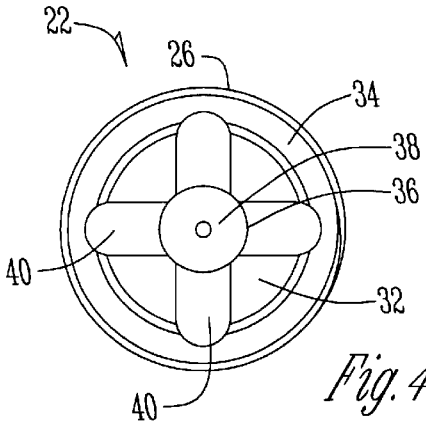
FIG. 4 is an end view of the forward end of the breech plug.
Figure 5:
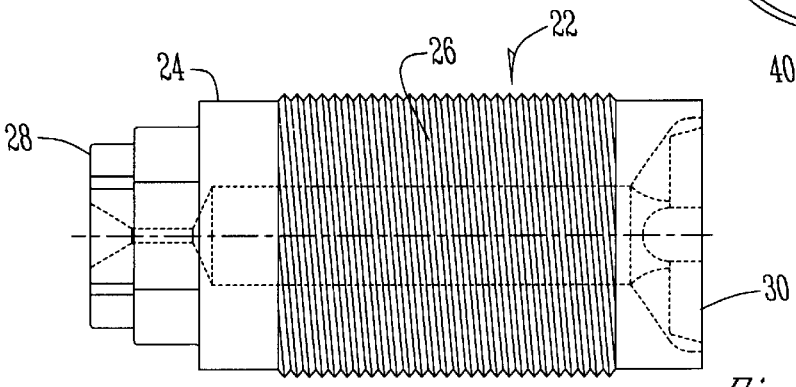
FIG. 5 is a side view of the breech plug of the present invention.

Referring now to the drawings, in which similar or corresponding parts are identified with the same reference numeral, and more particularly to FIG. 1, a muzzle-loading rifle includes a barrel 10 extending forwardly from a forward end of a receiver 12 which is mounted on a gun stuck 14. The numeral 16 refers generally to the bore of the barrel 10, which is located at the rearward end of the barrel 10 and designed to receive the propellant and projectile.

The breech plug 22 has an elongated body 24 with external threads 26. The breech plug 22 is threadably mounted adjacent to the rearward end of the bore 16 of the barrel 10. The body 24 has a forward 30 and rearward 28 end with a circular depression 32 in the forward end 30 surrounded by an annular rim 34. The annular rim 34 has a diameter slightly less than the diameter of the bore 16 of the rifle.

The circular depression 32 has a tapered bottom surface that slopes inwardly and rearwardly and terminates in a center portion 36 in communication with a center bore 38 that extends longitudinally along the center axis of the body 24. Within the circular depression 32, are a pair of intersecting grooves 40 that extend across the depression 32. The grooves 40 have outer ends that extend from the edge of the rim 34 inwardly and rearwardly across the tapered bottom surface to the center portion 36 in communication with the center bore 38 of the body 24.

In use, a percussion element 42 is positioned rearwardly of the breech plug 22. When struck by a hammer 44 the percussion element 42 is fired and an ignition flame travels through the central bore 38 the length of the body 24 to ignite the propellant 18 in the bore 16 of the barrel 10. While the propellant 18 can be comprised of a loose powder, the breech plug is intended for use with powder in a cylindrical pellet form such as Pyrodex pelletized powder. The grooves 40 in the circular depression 32 allow the ignition flame to emerge from the center bore 38 to move forwardly and outwardly through the grooves 40 to the inner diameter of the bore 16 of the barrel 10 to ignite the propellant 18. By disbursing the ignition flame through the grooves 40, a greater area of the base of the propellant 18 is ignited which results in a faster ignition with greater velocity and greater lock time.

Further, the outer ends of the grooves 40 extend into the annular rim 34 allowing the ignition flame to ignite the propellant 18 on the outer edges as well as the base. When the breech plug 22 is used with a pelletized powder wherein about two or three pellets of fifty grains each are placed in the barrel, instead of a quantity of loose powder, the flame ignites the edges of the propellant 18 along with the base resulting in faster ignition.

It is therefore seen that the breech plug 22 improves the ignition of the propellant 18 particularly when used with powder in pellet form.

This invention will therefore achieve all of the stated objectives.

What is claimed is:

1. A breech plug for a muzzle-loading rifle, the rifle with an elongated bore, the barrel having a rearward end connected to a receiver, a breech opening in the receiver rearwardly of the barrel, a trigger mechanism in the receiver including a striker pin adjacent the breech opening and in line with the barrel, and a breech plug in the rearward end of the barrel, the breech plug comprising:

an elongated body with external threads threadably mounted adjacent the rearward end of the bore of the barrel, the body having rearward and forward ends, a circular depression in the forward end of the body surrounded by an annular rim, the annular rim having an inner diameter slightly less than the diameter of the bore of the barrel, the depression having a tapered bottom surface that slopes inwardly and rearwardly and terminating in a center portion in communication with a center bore extending longitudinally along a center axis of the body, a pair of intersecting grooves extending across the depression and having outer ends extending from an outer edge of the rim, and thence inwardly and rearwardly across the tapered bottom surface to the center portion in communication with the center bore of the body to permit an ignition flame emerging from the center bore to move forwardly and outwardly through the grooves to the inner diameter of the bore of the barrel to envelope in flame an elongated cylinderical propellant charge having a rearward end positioned within the rim of the body.

2. The device of claim 1 wherein the ends of the grooves at the outer edge of the rim extend into an interior diameter of the rim to permit an ignition flame to move forwardly past the rearward end of an elongated cylindrical propellant positioned snuggly within the rim.

3. The device of claim 1 or 2 wherein said propellant is a powder charge in pellet form.

4. A breech plug in the rearward end of the barrel, the breech plug comprising:

an elongated body with external threads threadably mounted adjacent the rearward end of the bore of the barrel, the body having rearward and forward ends, a circular depression in the forward end of the body surrounded by an annular rim, the annular rim having an inner diameter slightly less than the diameter of the bore of the barrel, the depression having a tapered bottom surface that slopes inwardly and rearwardly and terminating in a center portion in communication with a center bore extending longitudinally along a center axis of the body, a pair of intersecting grooves extending across the depression and having outer ends extending from an outer edge of the rim, and thence inwardly and rearwardly across the tapered bottom surface to the center portion in communication with the center bore of the body to permit an ignition flame emerging from the center bore to move forwardly and outwardly through the grooves to the inner diameter of the bore of the barrel to envelope in flame an elongated cylinderical propellant charge having a rearward end positioned within the rim of the body.

5. The device of claim 4 wherein said propellant is a powder charge in pellet form.

* * * * *